US006104292A

United States Patent [19]

Rombom et al.

[11] Patent Number: 6,104,292

[45] Date of Patent: Aug. 15, 2000

[54] BABY BOTTLE ATTACHMENT WITH SOUND MONITOR/TRANSMITTER AND RECORDABLE/PRE-RECORDED SOUND PLAYBACK

[76] Inventors: Herman Rombom; Judi Shepard Rombom; Sarah Shepard Rombom, all of 260 W. 72nd St., No. 3-D, New York, N.Y. 10023

[21] Appl. No.: 09/262,461

[22] Filed: Mar. 4, 1999

Related U.S. Application Data

[60] Provisional application No. 60/076,733, Mar. 4, 1998.

[51] Int. Cl.[7] ..... G08B 23/00

[52] U.S. Cl. ..... 340/573.1; 340/686; 340/687; 340/692; 455/66; 455/127; 455/128

[58] Field of Search ..... 340/573.1, 686; 455/127, 128, 344; 215/11.1, 11 R, 11 C; 5/655; 222/192; 248/105; 368/10; 434/238

[56] References Cited

U.S. PATENT DOCUMENTS

| | | | |
|---|---|---|---|
| 4,678,093 | 7/1987 | Allen | 215/11 R |
| 5,070,539 | 12/1991 | Cheng | 455/344 |
| 5,280,635 | 1/1994 | Knoedler et al. | 455/128 |
| 5,305,928 | 4/1994 | Verdaguer | 222/192 |
| 5,344,034 | 9/1994 | Eagan | 215/11.1 |
| 5,365,494 | 11/1994 | Lynch | 368/10 |
| 5,446,934 | 9/1995 | Frazier | 5/655 |
| 5,664,745 | 9/1997 | Hadaway | 248/105 |
| 5,757,274 | 5/1998 | Slomowitz et al. | 340/573 |

*Primary Examiner*—Daniel J. Wu
*Assistant Examiner*—Phung Nguyen
*Attorney, Agent, or Firm*—Kenneth A. Roddy

[57] ABSTRACT

A baby bottle attachment has a cylindrical housing containing electronic integrated circuitry that removably attaches to a baby bottle. The bottle attachment functions as a room monitor for monitoring the sounds of an infant, as an educational device that plays custom-recorded or pre-recorded educational messages and sounds, and as an amusement device that plays various sounds to educate and amuse the infant. A base unit containing a battery charger and an FM receiver may also be provided for holding the bottle attachment, recharging its battery, and serving as a remote receiver for monitoring sounds transmitted by the bottle attachment when in use.

12 Claims, 9 Drawing Sheets

MONITOR/FM TRANSMITTER

CUSTOM-RECORD/PLAY BACK

PRE-RECORD/PLAYBACK

BABY BOTTLE ATTACHMENT WITH SOUND MONITOR/TRANSMITTER AND RECORDABLE/PRE-RECORDED SOUND PLAYBACK

CROSS REFERENCE TO RELATED APPLICATION

This application claims priority of U.S. Provisional Application Serial No. 60/076,733 filed Mar. 4, 1998.

BACKGROUND OF THE INVENTION

1. Field of the Invention

This invention relates generally to room monitors and record/playback devices, and more particularly to a baby bottle attachment having a cylindrical housing containing electronic circuitry that attaches to a baby bottle and functions as a room monitor for monitoring the sounds of an infant, as an educational device that plays custom-recorded and pre-recorded educational messages and sounds, and as an amusement device that plays various sounds to educate and amuse the infant.

2. Brief Description of the Prior Art

There is compelling evidence of new scientific studies of infants in the August 1997 edition of the *Journal of Science*. Studies done at the University of Kansas, University of Anchorage and State University of New York at Buffalo confirmed that a newborn baby's sense of hearing plays an extremely important role in his or her cultural and educational development. Babies listening skills become more sophisticated over time and at just four months old, babies will start to recognize words and absorb and start to relate to the spoken words that previously were not thought possible.

The professors observed forty-two babies of various economic backgrounds from seven to twelve months old until they turned three years of age. At the age of about three years old the child discards the use of a baby bottle. Spending one hour per month recording their interaction with people, the researchers determined that the average number of words directed at each child per hour (with spoken words from strangers as well as parents). The researcher then compared those numbers with how well each child performed on intelligence tests at age three and at age nine.

"The relationship between the number of words spoken to the children when they were babies and their later test scores was remarkable", said Betty Hart, Ph.D., professor emeritus of human development at the University of Kansas at Lawrence. "Those testing at the highest levels had been exposed to more than three times the amount of spoken language than had the youngsters who scored the lowest—2,100 words versus 600 words per hour." As they grew older, the children whose parents talked to them the most continued to have a significant advantage over their peers. "Since children are constantly building upon their prior experience," said Hart, "attempting to catch up is almost like running after a speeding train."

There are several patents that disclose various room monitor devices and recording and playback devices that are used for infants and small children, none of which have the combination of utilitarian features of the present invention working together as a whole.

Jo et al, U.S. Pat. No. 5,489,893 discloses a memory type recording/playback device which has a cylindrical case that is received on the bottom of a baby bottle and contains an IC microchip, a microphone for recording human voice or sounds that are stored on the microchip, a speaker, battery, a record button, and a pressdown playback button that activates the playback circuit when a baby bottle is inserted into the case. The device allows the mother's voice or other sounds to be recorded and then played back. This device is inoperable until a baby bottle is inserted and is incapable of monitoring the sounds of the infant.

Eagan, U.S. Pat. No. 5,344,034 discloses a cup-shaped housing that connects onto the bottom of a baby bottle and contains a battery, an on-off switch and a motion-activated microswitch. A series of interchangeable wafer-like disc shaped containers each containing an IC microchip and speaker and having different musical information stored therein, can be inserted into the bottom of the housing to play a variety of different musical tunes. This device is merely an amusement device and is incapable of monitoring the sounds of an infant and of recording custom messages.

Arad et al, U.S. Pat. No. 5,125,866 discloses a toy that simulates the appearance of a baby bottle and contains a battery, an on-off switch and a series of buttons connected to a series of IC microchip circuits each having different human sounds stored therein. The toy produces various human sounds when the buttons are depressed, such as crying, laughing, and burping. This device is merely an amusement device and is incapable of monitoring the sounds of an infant and of recording custom messages.

To, U.S. Pat. No. 4,898,060 discloses a two-piece base member comprising an upper part that connects onto the bottom of a baby bottle and a lower part that contains an IC microchip having musical information stored therein, a speaker, battery, an on-off switch and mercury switches. The device plays prerecorded music when the bottle is tilted from an upright position. This device is made in two separable parts so that the musical producing device may be connected to other articles. This device is merely an amusement device and is incapable of monitoring the sounds of an infant and of recording custom messages.

Allen, U.S. Pat. No. 4,678,093 discloses a base member that is fastened to the bottom of a baby bottle and contains an IC microchip having musical information stored therein, a speaker, battery, an on-off switch and mercury switches. The device plays prerecorded music when the bottle is tilted from an upright position. This device is merely an amusement device and is incapable of monitoring the sounds of an infant and of recording custom messages.

Room monitors for monitoring the sounds of an infant are also known in the art, however conventional monitors of this type are box-like units that are placed in the infant's room or on a dresser near the infant, and are incapable of functioning as an educational device that plays custom-recorded or pre-recorded messages or sounds to educate and amuse the infant.

The present invention is distinguished over the prior art in general, and these patents in particular by a baby bottle attachment having a cylindrical housing containing electronic integrated circuitry that removably attaches to a baby bottle. The bottle attachment functions as a room monitor for monitoring the sounds of an infant, as an educational device that plays custom-recorded or pre-recorded educational messages and sounds, and as an amusement device that plays various sounds to educate and amuse the infant. A base unit containing a battery charger and an FM receiver may also be provided for holding the bottle attachment, recharging its battery, and serving as a remote receiver for monitoring sounds transmitted by the bottle attachment when in use.

SUMMARY OF THE INVENTION

It is therefore an object of the present invention to provide a baby bottle attachment having a cylindrical housing which removably receives a baby bottle and performs multiple functions as a room monitor for monitoring the sounds of an infant, as an educational device that plays custom recorded or prerecorded educational messages or sounds to educate the infant, and as an amusement device that plays various sounds to educate and amuse the infant.

It is another object of this invention to provide an electronic baby bottle attachment that receives a baby bottle and will reside very close to the infant to monitor and transmit the sounds of an infant.

Another object of this invention is to provide an electronic baby bottle attachment that receives a baby bottle and will monitor the sounds of an infant and transmit the sounds to a conventional FM radio receiver.

Another object of this invention is to provide an electronic baby bottle attachment that receives a baby bottle and will play custom recorded or prerecorded educational messages to educate an infant or toddler even when an adult is not present or actually speaking to the child.

Another object of this invention is to provide an electronic baby bottle attachment that receives a baby bottle and will play custom recorded or prerecorded educational messages to educate a child from its very early nursing stages through the toddler stage and until it no longer uses a bottle.

Another object of this invention is to provide an electronic baby bottle attachment that receives a baby bottle and allows a parent, grandparent, siblings, etc., to record custom messages in their own voice for the infant to hear during its very early nursing stages even when the person is not present or actually speaking to the child.

Another object of this invention is to provide an electronic baby bottle attachment that receives a baby bottle and allows an adult, guardian, or baby-sitter to receive and record memo messages to be listened to by another person at a later time, or when needed.

Another object of this invention is to provide an electronic baby bottle attachment that receives a baby bottle and will play professionally recorded educational messages in various languages to teach or familiarize the infant with various languages and learning skills during its very early nursing stages and through the toddler stage.

A further object of this invention is to provide an electronic baby bottle attachment that performs multiple functions of a room monitor, as an educational device, and as an amusement device, which is inexpensive to manufacture, easily transported, for example in a diaper bag, and is rugged and reliable in operation.

A still further object of this invention is to provide a base unit for holding an electronic baby bottle attachment and charging its battery, and also serves as an FM receiver and may also include a night light and clock.

Other objects of the invention will become apparent from time to time throughout the specification and claims as hereinafter related.

The above noted objects and other objects of the invention are accomplished by a electronic baby bottle attachment having a cylindrical housing containing electronic integrated circuitry that removably attaches to a baby bottle. The bottle attachment functions as a room monitor for monitoring the sounds of an infant, as an educational device that plays custom recorded or pre-recorded educational messages and sounds, and as an amusement device that plays various sounds to educate and amuse the infant. A base unit containing a battery charger and an FM receiver may also be provided for holding the bottle attachment, recharging its battery, and serving as a remote receiver for monitoring sounds transmitted by the bottle attachment when in use.

DESCRIPTION OF THE PREFERRED EMBODIMENT

Figure 1:
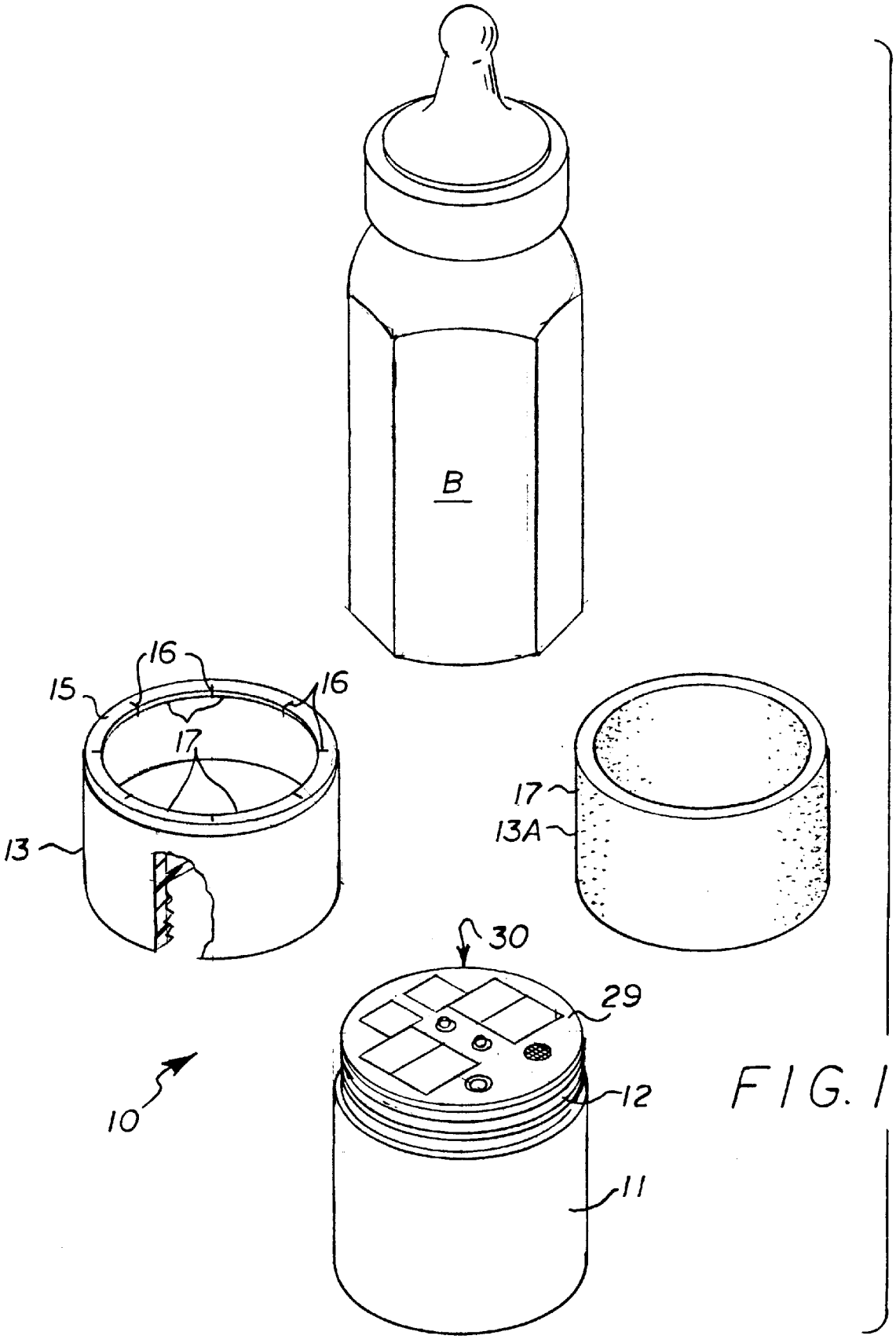
FIG. 1 is an exploded perspective view of the baby bottle attachment in accordance with the present invention, shown in an unassembled condition.

Referring to the drawings by numerals of reference, there is shown in FIG. 1, a preferred electronic baby bottle attachment 10 that receives a baby bottle B and performs multiple functions as a room monitor, as an educational device, and as an amusement device. The attachment has a cylindrical housing 11 provided with external threads 12 at its upper end. An adapter 13 having an internally threaded lower portion 14 is threadedly received on the external threads 12 of the housing 11. The upper end of the adapter 11 is configured to receive the lower end of the baby bottle B. The upper end of the adapter 11 may be provided with a resilient ring having radially extending slots 15 defining gripping segments 16 that frictionally grip the lower end of the bottle and compensate for bottles of different size and shapes.

Alternatively, the adapter 13A may be a cylindrical resilient sleeve 17 that fits onto the upper end of the housing 11 and receives and frictionally grips the lower end of the bottle B. It should be understood that the housing 11 may be attached to the bottle by various other means, without departing from the scope of the invention.

Figure 3:
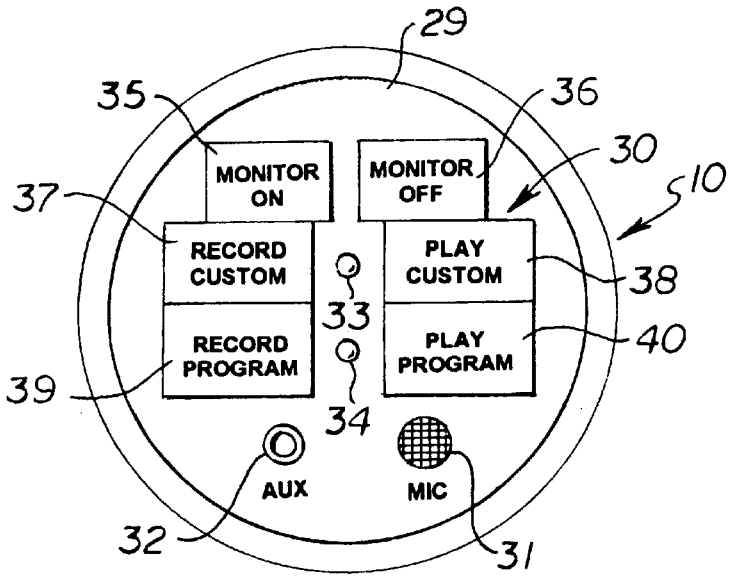
FIG. 3 is a top plan view of the baby bottle attachment housing showing the face plate control panel with keypad buttons, the microphone and audio input jack.
Figure 2:
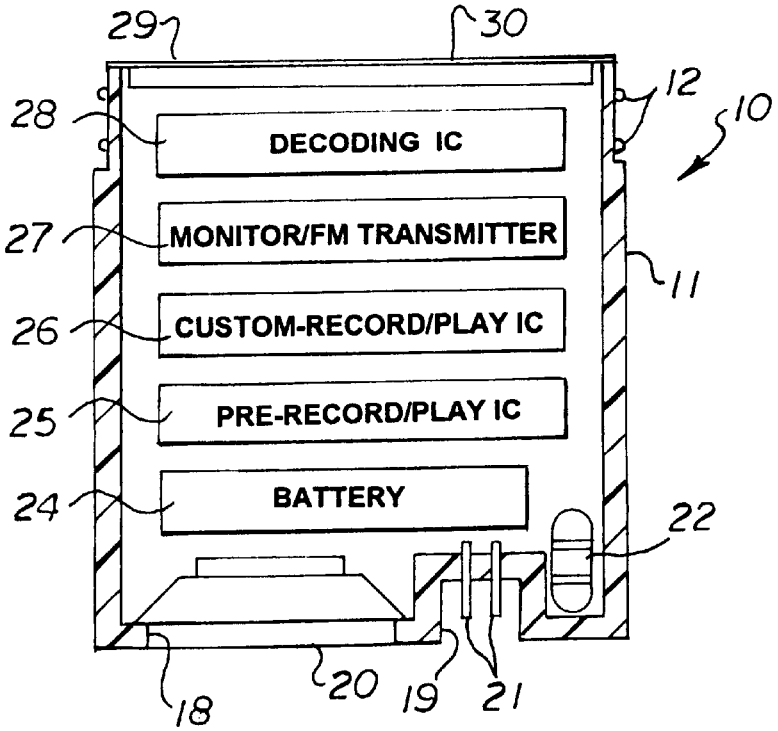
FIG. 2 is a side view in cross section showing schematically the components that are contained in the interior of the housing of the baby bottle attachment.

Referring now additionally to FIGS. 2 and 3, the cylindrical housing 11 of the attachment 10 is a molded hollow cup-like unit having an opening 18 and a cavity 19 formed in its bottom wall 20. A set of battery recharging pins 21 are secured in the bottom wall 20 with their bottom ends disposed in the cavity 19. A mercury switch 22 is secured at the bottom of the housing 11. An audio speaker 23 is disposed over the opening 19. A grill (not shown) may also cover the opening 19. A rechargeable DC Ni-Cad battery 24 is mounted above the speaker 23 and connected by wire leads (not shown) to the upper ends of the battery charging pins 21.

A circuit board having a pre-record/playback circuit 25, a circuit board having a custom-record/playback circuit 26, a circuit board having a monitor microphone and FM transmitter circuit 27, and a circuit board having a decoding circuit 18 are mounted in the housing 11 above the battery 24. The battery 24 is connected via wire leads (not shown) to supply power to the electronic circuits. The particular circuit details will be described hereinafter. A flat circular control panel faceplate 29 with a keypad 30 is mounted above the circuit boards 25, 26, 27, and 28 and encloses the open top end of the housing 11.

As best seen from the top in FIG. 3, a microphone 31, such as a commercially available Electret type microphone, is mounted on the control panel faceplate 29 and connected via wire leads to the sound monitor/FM transmitter circuit 27. An auxiliary audio input jack 32 mounted on the control panel faceplate 29 is connected via wire leads (not shown) to the custom-record/playback circuit 26. A pair of LED's (light emitting diodes) 33 and 34 are mounted on the control panel faceplate 29 and connected via wire leads to the custom-record/playback circuit 26 and the pre-record/playback circuit 25, respectively.

In a preferred embodiment, the keypad 30 mounted on the control panel faceplate 29 is a touch-sensitive membrane switch keypad. The buttons of the keypad 30 are connected through the decoder circuit 28 to direct a momentary action low voltage DC logic-level signal to the pre-record/playback circuit 25 and the custom-record/playback circuit 26 to carry out the desired operation when the corresponding button is pressed. The buttons are imprinted on a lamination on the keypad 30 and may be words and/or graphic symbols representing the function to be performed.

Still referring to FIG. 3, the keypad 30 includes a "MONITOR ON" button 35 which turns the sound monitor/FM transmitter circuit on, a "MONITOR OFF" button 36 which turns the sound monitor/FM transmitter circuit off, a "RECORD CUSTOM" button 37 which is pressed to record a custom personalized sound or message during, a "PLAY CUSTOM" button 38 which is pressed to play the custom recorded message, a "RECORD PROGRAM" button 39 which is pressed to record a custom sound or message from an auxiliary sound source, and a "PLAY PROGRAM" button 40 which is pressed to play a pre-recorded sound or message program.

Figure 4:
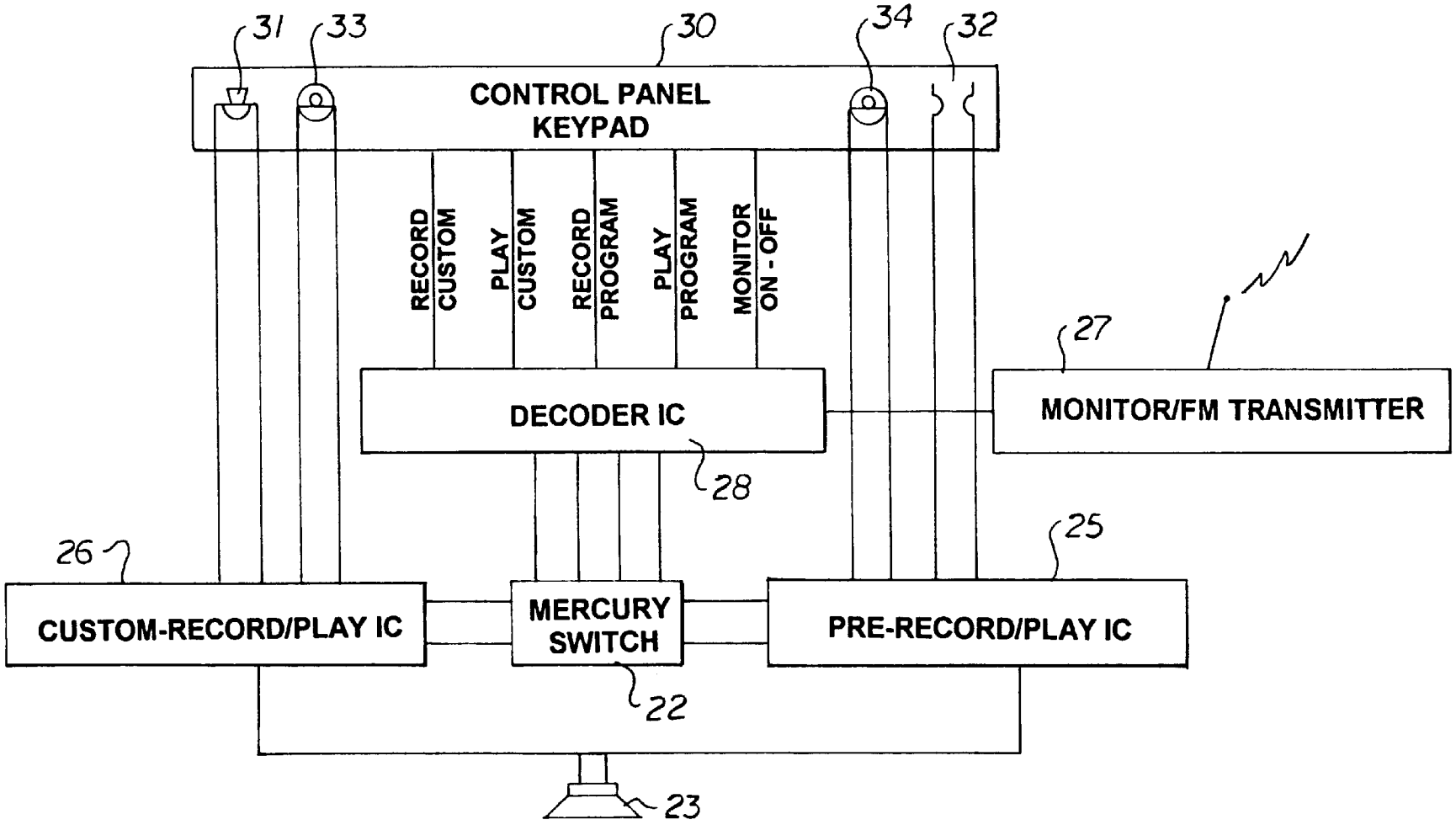
FIG. 4 is a schematic block diagram showing the relationship of the control panel and the electronic components contained in the baby bottle attachment.

FIG. 4 is a schematic block diagram showing the relationship of the control panel keypad 30 and the electronic components contained in the housing of the bottle attachment, and FIGS. 5, 6, 7 and 8 are schematic electronic diagrams of the decoder circuit 28, the monitor/FM transmitter circuit 28, the custom-record/playback circuit 26, and the pre-record/playback circuit 25 respectively.

The electronic components used in the decoder circuit 28, the monitor/FM transmitter circuit 27, the custom-record/playback circuit 26, and the pre-record/playback circuit 25, include integrated electronic circuit chips (IC chips) and other components that are commercially available from electronic supply houses. Therefore, the details of the particular integrated circuits are shown in the drawings, but the signal path and biasing path aspects of the commercially available circuits will not be described in detail in the following discussion, with the exception of particular modifications. It is assumed that a person skilled in the art will have a complete understanding of the circuitry from the electrical schematics depicted in the drawings.

Figure 5:
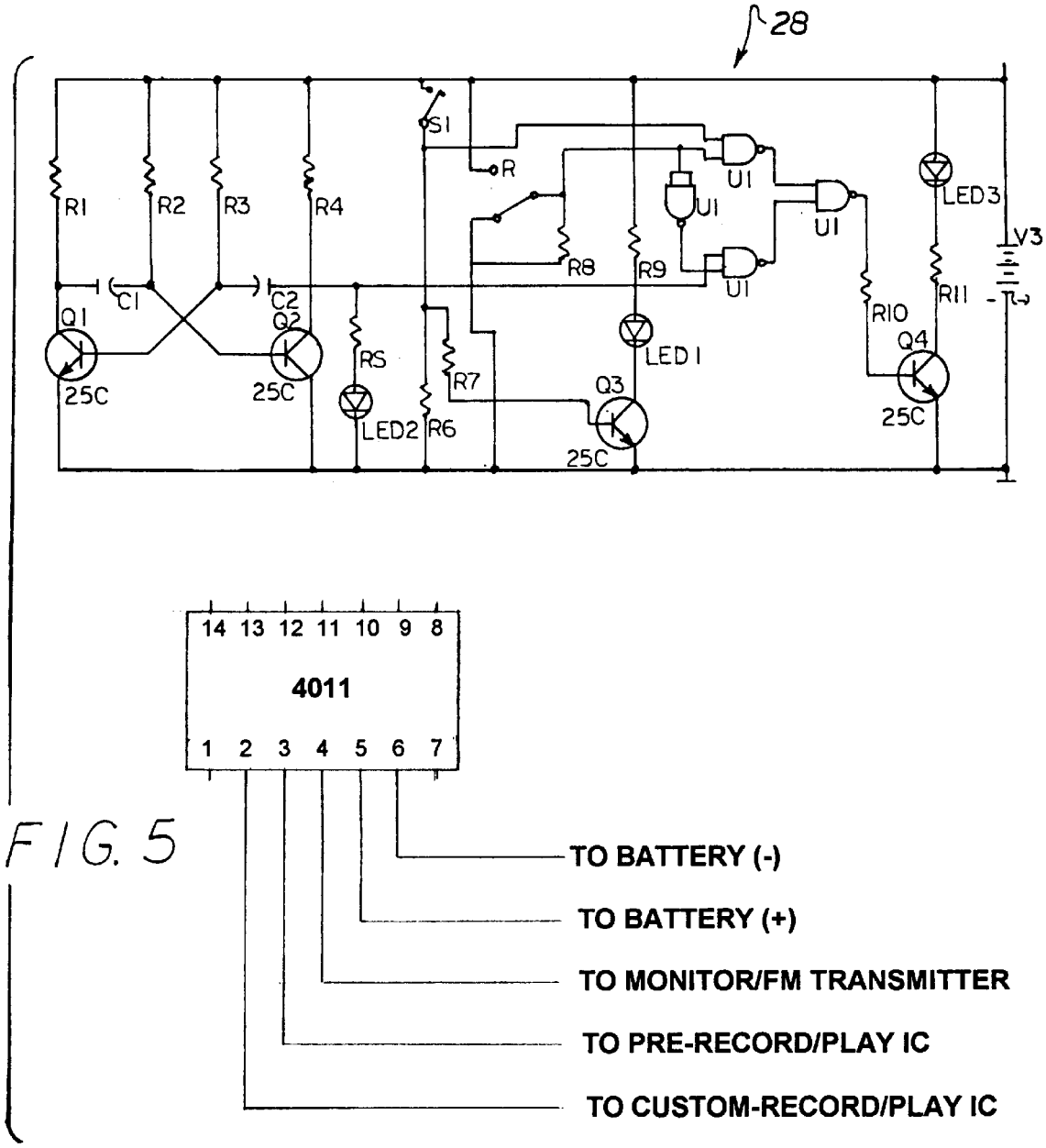
FIG. 5 is a schematic electronic diagram showing the decoder integrated circuit.

The decoder circuit shown in FIG. 5, utilizes a commercially available 4011 CMOS Decoder IC chip 28 having built-in memory and flip-flop switching circuits made up of NAND gates and transistors and resistors. The decoder circuit 28 is connected to the battery 24 and the buttons on the keypad 30 and serves as the switching control circuit to decode the DC logic-level signals inputted by the buttons on the keypad to send power or data signals to control the operation of the monitor/FM transmitter circuit 27, the custom-record/playback circuit 26, and the pre-record/playback circuit 25. The operation of the decoder circuit 28 is controlled by the buttons 35, 36, 37, 38, 39 and 40 of the keypad 30. The IC CMOS decoder chip 28 of the decoder circuit will remember when a signal has been input and depending upon the signal input will switch the transistors from positive to negative to open or close the mode of operation of the custom-record/playback circuit 26, the pre-record/playback circuit 25, and the monitor/FM transmitter circuit 27.

Figure 6:
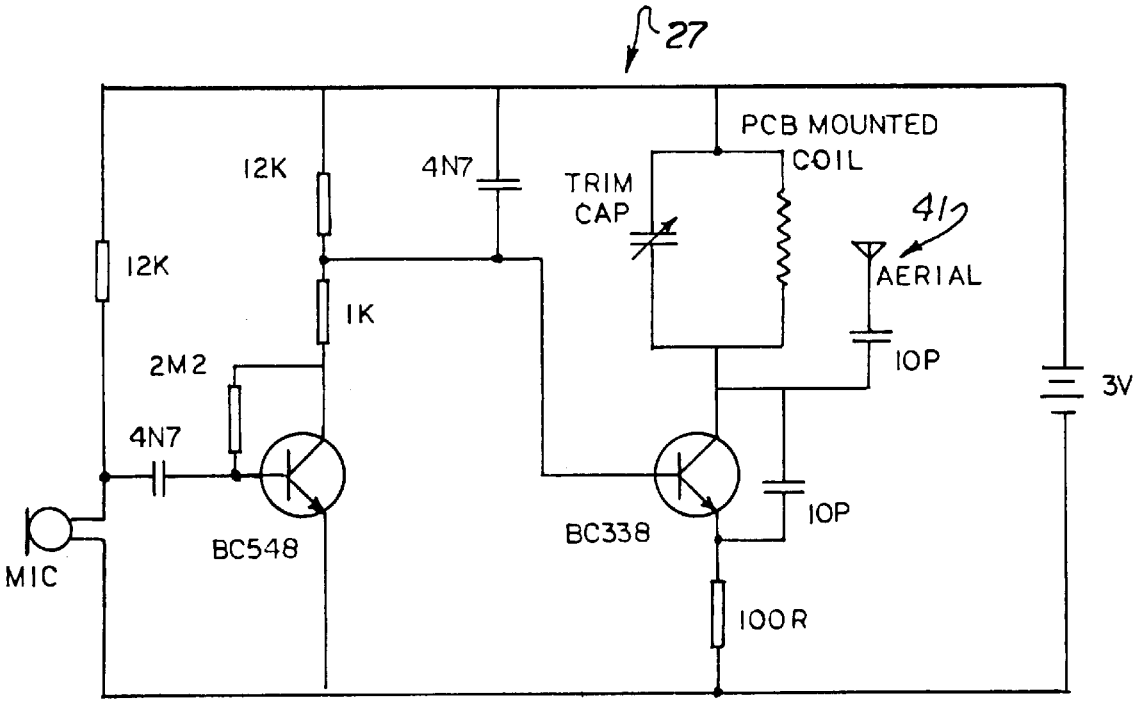
FIG. 6 is a schematic electronic diagram showing the sound monitor/FM transmitter circuit.

FIG. 6 is an electronic schematic diagram of the sound monitor/FM transmitter circuit 27, which in a preferred embodiment is a commercially available FM transmitter circuit of the type having a built-in microphone, and a coil and trim capacitor for adjustably tuning the transmitted FM signal along the tuning band of from about 88 MHz to about 100 MHz. The FM transmitting circuit is modified to include a small 1" TV antenna 41 with a 470 ohm resistor across its two ends. When the "MONITOR ON" button 35 on the keypad 30 is pressed, the decoder circuit 28 sends a signal to activate the sound monitor/FM transmitter circuit 27 and the monitor microphone picks up any sounds from the infant and the circuit transmits them as FM radio signals to a conventional FM radio receiver tuned to the same frequency as the transmitter, or to a base unit accessory for the bottle attachment (described hereinafter). The baby bottle does not have to be attached to the housing 11 of the bottle attachment to monitor the infant. In other words, the housing 11 can monitor sounds even when the bottle is not attached. The mercury switch 22 is not connected with the sound monitor/FM transmitter circuit 27 and, thus, the circuit will operate to monitor and transmit sounds when the housing 11 is disposed in any position.

The sound monitor/FM transmitter feature of the present invention allows any parent, baby-sitter or adult in charge to monitor all of the baby's sounds, movements and noises in the room. Because it is attached to the baby bottle, the sound monitor in the housing is either in the infant's hands or lying next to the infant, therefore, the microphone picks up any unusual sound or movement. The parent or adult having the FM radio tuned to the monitor can listen to determine if the infant is feeding, or may be choking or crying, as well as hear any normal sounds. The monitor can be left on at night when the child is alone and in the crib or bed. Thus, the sound monitor is very close to the child, unlike conventional room monitors that are placed on a changing table or dresser a distance from the infant.

Figure 7:
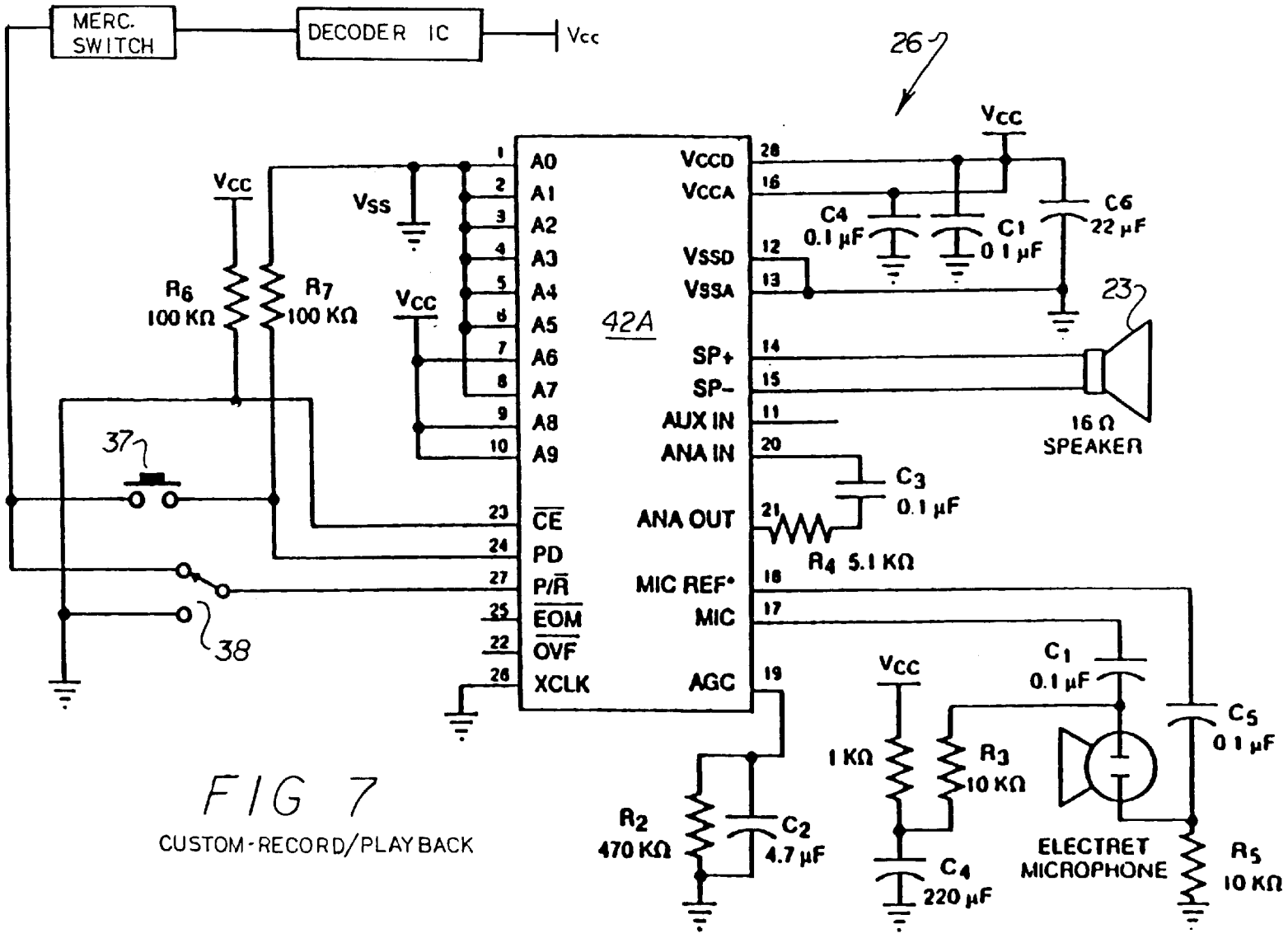
FIG. 7 is a schematic electronic diagram showing the custom-record/playback integrated circuit.
Figure 8:
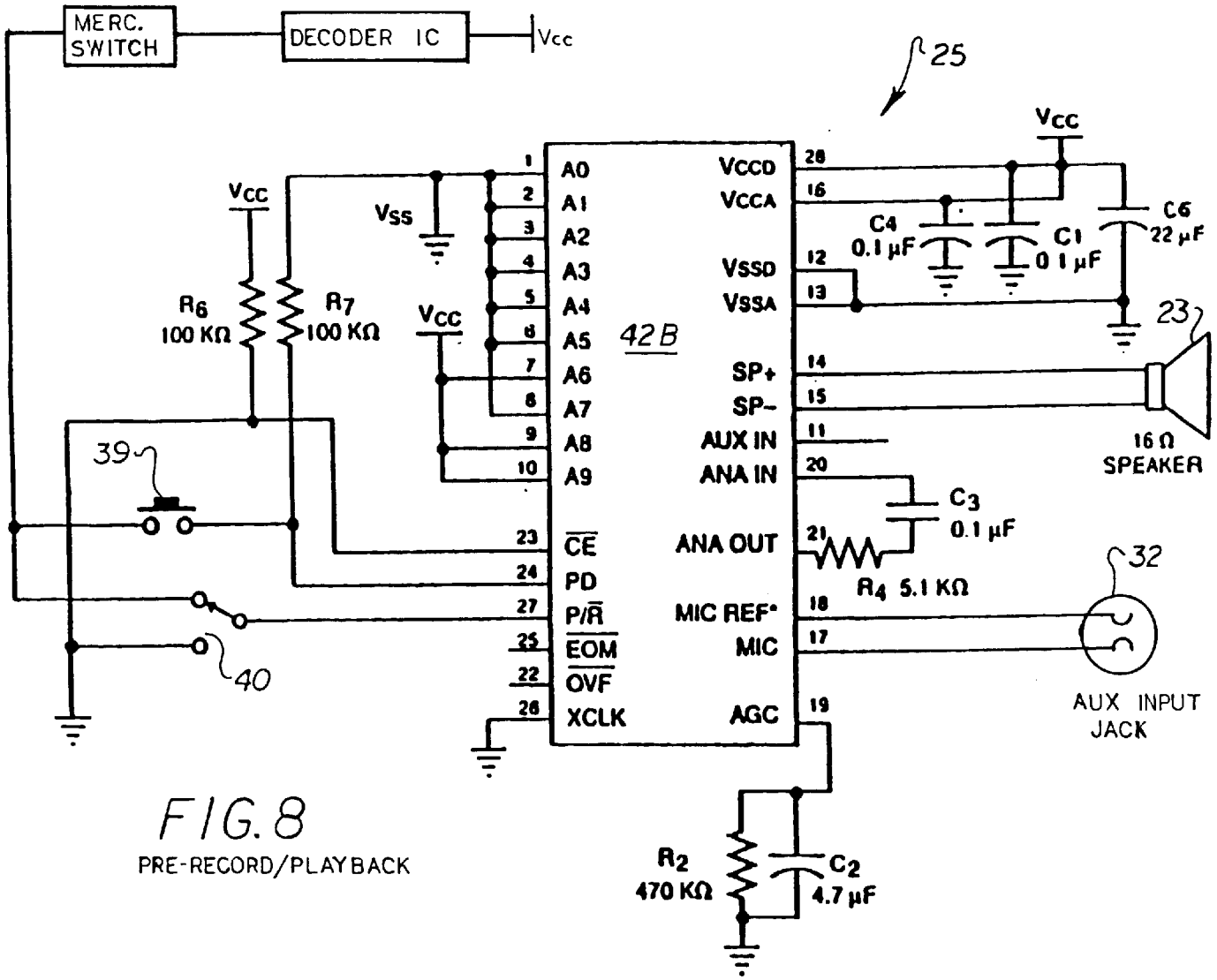
FIG. 8 is a schematic electronic diagram showing the pre-record/playback integrated circuit.

FIG. 7 is a schematic electronic diagram of the custom-record/playback circuit 26, and FIG. 8 is a schematic electronic diagram of the pre-record/playback circuit 25. The custom-record/playback circuit 26 (FIG. 7) and the pre-record/playback circuit 25 (FIG. 8) both utilize a commercially available ISD type digital voice record/playback IC chip 42A and 42B, respectively, each having a built-in amplifier and a record and playback capacity of up to 4 minutes. The digital voice record/playback IC chips 42A and 42B are also capable of looping the sound recorded in their respective memory. The speaker pins of each digital record/playback IC chip 42A and 42B are connected to the same single speaker 23 that is disposed at the bottom of the bottle attachment housing 11. A suitable speaker for use in the base of the attachment is a commercially available 16 OHM, 0.1 W, 400–12K Hz small Mylar speaker.

The mercury switch 22 disposed in the base of the attachment housing 11 has one contact coupled to the record/playback pin of the digital record/playback IC chip 42A in the respective custom-record/playback circuit 26 and the pre-record/playback circuit 25. The other contact of the mercury switch 22 is coupled to the respective pins of the decoder circuit 28 that control the record mode and the playback looping mode associated with the record and play buttons on the keypad 30.

As shown in FIG. 7, the microphone 31, such as a commercially available Electret type microphone, is mounted on the control panel faceplate 29 and connected to the microphone pins of the digital record/playback IC chip 42A of the custom-record/playback circuit 26 for allowing the user to record any sound or message. The LED 33 mounted on the control panel faceplate 29 is connected between the record pin and the end of memory pin of the digital record/playback IC chip 42A of the custom-record/playback circuit 26 to indicate when the memory is full.

As shown in FIG. 8, the pre-record/playback circuit 25 does not utilize a microphone, but instead, the audio input jack 32 mounted on the control panel faceplate 29 is connected to the microphone pins of the digital record/playback IC chip 42B for recording pre-recorded sounds from a tape cassette player, radio, CD player, TV, or other audio source. The LED 34 mounted on the control panel faceplate 29 is connected between the record pin and the end of memory pin of the digital record/playback IC chip 42B of the pre-record/playback circuit 25 to indicate when the memory is full.

To record custom or pre-recorded sounds or messages on the microchips 42A and 42B, the cylindrical housing 11 must be in a upright position (faceplate up) due to the mercury switch 22 in the recording/playback circuits. The housing 11 does not have to be attached to the baby bottle to record or play the recorded sounds or messages. The recorded sounds will be played when the "PLAY CUSTOM" button 38 in the custom-record/playback circuit 26 or the "PLAY PROGRAM" button 40 in the pre-record/playback circuit 25 is pressed and the housing 11 is tilted to an angle sufficient angle to close the contacts and complete the playback circuit, as when the infant is taking the bottle or the bottle is lying on its side next to the infant.

To record a custom sound or message, the "RECORD CUSTOM" button 37 on the keypad 30 is pressed and the user speaks into the microphone 31 in the control panel faceplate 29 to record a sound or message in their own voice. Pressing the "RECORD CUSTOM" button 37 will send a signal to decoder circuit 28, which will pull the play/record pin of the IC chip 42A of the custom-record/playback circuit 26 low, and set the circuit to the record mode to record the personalized sound or message into memory via the microphone 31 when the bottle attachment housing 11 is in an upright position. At the same time, the LED 33 will come on and stay on until the record memory is full and then go off.

To play the custom recorded sound or message, the "PLAY CUSTOM" button 38 on the keypad 30 is pressed and the sound or message is reproduced through the audio speaker 23. Pressing the "PLAY CUSTOM" button 38 will send a signal to decoder circuit 28 which activate the custom-record/playback circuit 26 to play the custom recorded sound or message stored in memory. If the bottle attachment housing 11 is tilted to close the contacts of the mercury switch 22, the play-loop pin is pulled low, and the sound or message will play in an endless loop until power is removed from the mercury switch or the bottle attachment is placed in an upright position. If the bottle attachment is in an upright position, the mercury switch contacts are open and the playing will continue until the end of the sound or message is reached and then stop.

The custom-record feature allows a parent, grandparent, siblings, and others to custom record songs, poems, stories, messages, in their own voice for the infant to hear during its very early nursing stages even when the person is not present or actually speaking to the child. This will allow the infant to become familiar with the person's voice and develop a closeness during its infancy at its nursing stage. For example, a babysitter may sit in a rocker and play a lullaby in the mother's voice while the infant is feeding, or at other times to calm the infant even though the mother is not present.

The custom-record/playback circuit 26 also provides the baby bottle attachment with a memo record feature. For example, the user may record a message of up to about four minutes in length. The memo message feature allows a parent, guardian or baby-sitter to record a memo which is meant to be heard by another adult who may not be present at the time.

The following are example of various memos that may be recorded: Child Care Instructions such as: (a) Feeding Instructions, (b) Food Allergies, (c) Medication Instructions, (d) Bedtime, (e) Child's behavior patterns, (F) Child's doctor's name and phone number, (g) Local hospital, (h) Police number, (i) Poison control center number, (j) Emergency contact number, (k) Location of the parent, (l) Personal messages to the infant/child, (m) Personal messages from the baby-sitter to the parent.

The pre-record/playback circuit 25 is used to record and play pre-recorded sound and programs that are down-loaded from another audio source and stored on the microchip. To install a digital sound program, a male plug at one end of a coaxial cable or phono cable is connected into the auxiliary input jack 32 on the control panel faceplate 29 and its other end is connected into the ear phone jack of a tape cassette, CD player, radio, or TV, etc., and the "RECORD PROGRAM" button 39 is pressed. And the remote sound source is started to record the program.

Pressing "RECORD PROGRAM" button 39 will send a signal to decoder circuit 28, which will pull the play/record pin of the IC chip 42B of the pre-record/playback circuit 25 low, and set the circuit to the record mode to record the sound or program into memory from the tape cassette player, CD player, radio, etc., via the auxiliary input audio jack 32 when the bottle attachment housing 11 is in an upright position. At the same time, the LED 34 will come on and stay on until the record memory is full and then go off.

To play the pre-recorded program, the "PLAY PROGRAM" button 40 on the keypad 30 is pressed and the recorded sound is reproduced through the audio speaker 23. The housing 11 does not have to be attached to the baby bottle to record or play the recorded sound program. Pressing "PLAY PROGRAM" button 40 will send a signal to decoder circuit 28 which pull the play-loop pin of the IC chip 42B low and activate the circuit 25 to start playing the pre-recorded sound stored in memory. If the bottle attachment housing 11 is tilted to close the contacts of the mercury switch 22, and the sound or message will play in an endless loop until power is removed from the mercury switch or the bottle attachment housing is placed in an upright position. If the bottle attachment housing is in an upright position, the mercury switch contacts are open and the playing will continue until the end of the sound or message is reached and then stop.

A series of professional educational audio or sound programs from about twenty seconds to about one minute or up to about four minutes may be provided with the baby bottle attachment. The purpose of the pre-recorded program feature is to start the educational process of learning language and the formation of words, numbers and sounds and to develop the infant's intellect as soon as possible during its infancy during its nursing stage.

The more words an infant hears, the better. With the present invention, an adult will be able to expose the infant to an infinite number of recorded words and sounds even when they are not around or actually speaking to the child.

Every time an infant hears the various pre-recorded programs, the child's brain and intellectual will be nourished. Studies indicate that an infant benefits from being talked to directly without any background noise (no distractions). This means turning off the television, radio, stereo or other sounds that may interfere with the child's concentration level. Because the present invention is attached to the baby bottle, these sounds are very direct and will have the infant's undivided attention.

The pre-recorded programs for parents to use can come in a variety of languages and therefore be of benefit to many people of different ethnic backgrounds from other countries. Bilingual programs can also be provided. This will give the infant a start in another language in which the parent may not be fluent. Additional professional prerecorded educational and entertaining programs available at different levels according to the infant/child's age can be recorded onto the microchip as often as the parent desires.

In a preferred embodiment, the baby bottle attachment 10 will be accompanied with an original package of pre-recorded instructional programs on tape cassette or CD that will include all of the instructions on how to use additional programs, as well as the equipment needed to do so.

The following are examples of pre-recorded programs which may be provided with the baby bottle attachment:

1. Animal sounds and spelling recognition; "C-A-T spells Cat . . . Cat sounds like this . . . Meow, etc."
2. Alphabet recognition; "A-B-C-D . . . X-Y-Z, etc."
3. Number recognition; "1-2-3 . . . 19-20, etc."
4. Common word recognition; "Mother, Father, Sister, Brother, House, Street, Car, Animal, Food, Drink, etc."
5. Nursery Rhymes; "Mother Goose, etc."
6. "Where do you live baby?"; Name, Address, Phone Number "Baby's name, 123 West X Street, New York, N.Y. 100XX, phone number (212) 123-4567"

Figure 9:
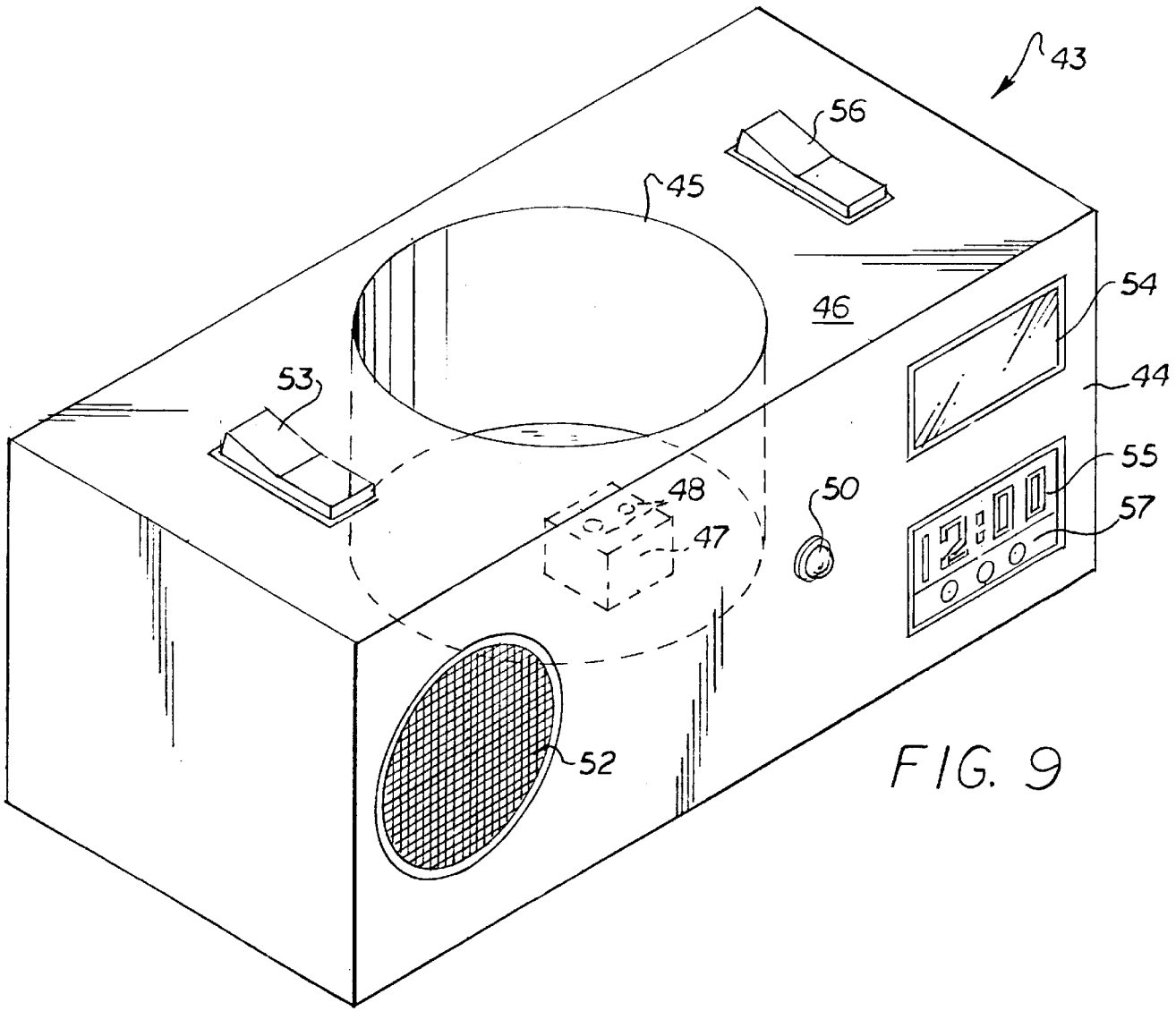
FIG. 9 is perspective view of a base unit for holding the electronic baby bottle attachment and charging its battery.
Figure 10:
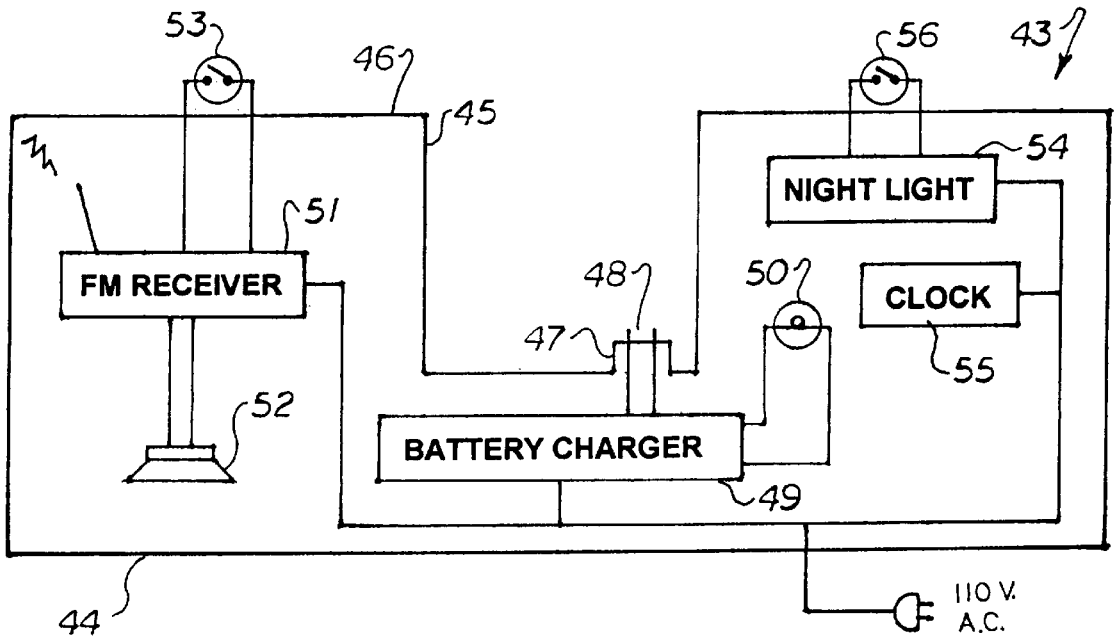
FIG. 10 is a schematic block diagram of the base unit showing the electrical circuits contained in its housing.

Although the battery of the baby bottle attachment 10 may be recharged using a conventional battery charger, a base unit 43, as shown in FIGS. 9 and 10 may be provided for use with the bottle attachment.

The base unit 43 has a box-like housing 44 with a cylindrical cavity 45 formed in its top wall 46 which is sized to receive the housing 11 of the baby bottle attachment 10. A battery recharge receptacle 47 sized and shaped to be slidably engaged in the cavity 19 of the bottle attachment housing 11 extends vertically a short distance from the bottom of the cavity 45 and contains a set of contacts 48 that mate with the battery recharge pins 21 of the housing 11. The base unit housing 44 contains a battery charging circuit 49 that is connected to a source of AC current and supplies current through the contacts 48 to charge the battery 24 of the bottle attachment. An LED 50 mounted on the housing 44 is coupled to the battery charging circuit 49 to indicate when the battery is being charged. In a preferred embodiment, the battery charger circuit is activated when the pins 21 of the bottle attachment housing are received in the contacts 48, and after the battery has been charged will drop to a trickle charge rate.

The base unit 43 may also include an FM receiver circuit 51 connected with the AC source for receiving the FM signals transmitted from the sound monitor/FM transmitter circuit 27 contained in the bottle attachment housing 11 and reproducing the sounds through a speaker 52. Operation of the FM receiver 51 is controlled by an ON-OFF switch 53 mounted on the base unit housing 44.

The base unit 43 may also have a night light 54 and a clock 55 mounted on its housing 44 and powered by the AC source. Operation of the night light 54 is controlled by an ON-OFF switch 56 mounted on the base unit housing 44. The clock 55 has a set of control buttons 57 for setting the time.

It should be understood that the base unit 43 may be provided with a removable cover and handle means for transporting the unit. The base unit 43 may be placed at a location remote from the baby bottle attachment and used to monitor the sounds from the baby, and for charging the battery of the bottle attachment when needed.

While this invention has been described fully and completely with special emphasis upon preferred embodiments, it should be understood that within the scope of the appended claims the invention may be practiced otherwise than as specifically described herein.

What is claimed is:

1. A room monitor/RF transmitter baby bottle attachment device, comprising:

a room monitor/RF transmitter unit having a housing with a receptacle sized and shaped to be removably attached to a baby bottle;

room monitoring circuit means including a microphone and radio frequency transmitter means in said housing for receiving sounds in the vicinity of said housing, converting them to RF signals and transmitting them to a remote radio frequency receiver; and battery means removably mounted in said housing for powering said radio frequency transmitter.

2. A combination room monitor/RF transmitter and sound recording/playback baby bottle attachment device comprising in combination:

a room monitor/RF transmitter and sound recording/playback unit having a housing with a receptacle sized and shaped to be removably attached to a baby bottle;

room monitoring circuit means including a microphone and radio frequency transmitter means in said housing for receiving sounds in the vicinity of said housing, converting them to RF signals and transmitting them to a remote radio frequency receiver;

battery means removably mounted in said housing for powering said radio frequency transmitter;

sound recording and playback circuit means in said housing electrically connected with said battery means including integrated circuit microchip means having memory in which recorded sound data is stored and from which sound data is retrieved, audio input means on said housing interconnected with said microchip means for recording sound data into said memory, and record switch means interconnected with said battery means and said microchip means for activating said microchip means to record sound data into said memory;

speaker means electrically connected with said microchip means for reproducing retrieved sound data as audible sounds; and playback switch means interconnected with said battery means and said microchip means for activating said microchip means to retrieve sound data stored in said memory and reproduce said retrieved sound data as audible sounds through said speaker means.

3. The combination room monitor/RF transmitter and sound recording/playback baby bottle attachment device according to claim 2, further comprising;

tilt switch means in said housing interconnected with said battery means and said microchip means for deactivating said microchip means to stop the playback of retrieved sound data stored in said memory after a predetermined interval upon said housing being tilted from an upright position.

4. The combination room monitor/RF transmitter and sound recording/playback baby bottle attachment device according to claim 2, wherein said audio input means comprises a second microphone for allowing a user to record sounds and messages into said memory.

5. The combination room monitor/RF transmitter and sound recording/playback baby bottle attachment device according to claim 2, wherein said audio input means comprises a jack connection for receiving a plug connected with a remote sound source to allow a user to record sounds from the remote source into said memory.

6. The combination room monitor/RF transmitter and sound recording/playback baby bottle attachment device according to claim 2, wherein said sound recording and playback circuit means and said integrated circuit microchip means includes a first memory and a second memory in which recorded sound data is stored and from which sound data is retrieved;

said audio input means comprises a second microphone for allowing a user to record sounds and messages into said first memory;

a jack connection for receiving a plug connected with a remote sound source to allow a user to record sounds from the remote source into said second memory; and first record switch means and second record switch means interconnected with said battery means and said microchip means for activating said microchip means to selectively record sound data into said first memory or into said second memory; and said playback switch means is interconnected with said battery means and said microchip means for selectively activating said microchip means to retrieve sound data stored in said first or said second memory and reproduce said retrieved sound data as audible sounds through said speaker means.

7. A dual sound recording/playback baby bottle attachment device comprising:

a dual sound recording/playback unit having a housing with a receptacle sized and shaped to be removably attached to a baby bottle;

battery means removably mounted in said housing;

sound recording and playback circuit means in said housing electrically connected with said battery means including integrated circuit microchip means having a first memory in which custom sound data and voice message data is stored and from which said custom sound data and voice message data is retrieved and a second memory in which pre-recorded sound data is stored and from which said pre-recorded sound data is retrieved;

speaker means electrically connected with said microchip means for reproducing retrieved sound data as audible sounds;

a microphone on said housing interconnected with said microchip means for recording custom sound data and voice message data into said first memory;

a jack connection on said housing interconnected with said microchip means for receiving a plug connected with a remote sound source for recording pre-recorded sound data from the remote sound source into said second memory;

first record switch means and second record switch means on said housing interconnected with said battery means and said microchip means for activating said microchip means to selectively record custom sound data and voice message data into said first memory or pre-recorded sound data from said remote sound source into said second memory; and playback switch means interconnected with said battery means and said microchip means for selectively activating said microchip means to retrieve sound data stored in said first or said second memory and reproduce said retrieved sound data as audible sounds through said speaker means.

8. The dual sound recording/playback baby bottle attachment device according to claim 7, further comprising:

a plurality of pre-recorded audio programs for use in connection with said baby bottle attachment capable of being played on a remote sound producing source having a plug connected with said jack on said housing to record said pre-recorded programs into said second memory.

9. A combination room monitoring baby bottle attachment and battery charger for monitoring the sounds of an infant in a room, comprising in combination:

a room monitor/RF transmitter baby bottle attachment unit having a housing with a receptacle sized and shaped to be removably attached to a baby bottle including a microphone and radio frequency transmitter means in said housing for receiving sounds in the vicinity of said housing, converting them to RF signals and transmitting them to a remote radio frequency receiver, and rechargeable battery means removably mounted in said housing for powering said radio frequency transmitter; and a battery charging unit adapted to be connected to an AC power source including battery charging circuit means electrically interconnected with said power source, said battery charging unit having a housing with a receptacle sized and shaped to removably receive said room monitor/RF transmitter baby bottle attachment unit housing, and electrical connection means in said receptacle for engaging said rechargeable battery means in said room monitor/RF transmitter baby bottle attachment unit in electrical charging relation to charge said rechargeable battery when said room monitor/RF transmitter baby bottle attachment unit housing is received in said battery charging unit housing receptacle.

10. The combination room monitoring baby bottle attachment and battery charger according to claim 9, further comprising:

radio frequency receiving circuit means in said battery charging unit housing electrically connected with said power source for receiving RF signals transmitted from said radio frequency transmitter means in said room monitor/RF transmitter baby bottle attachment unit housing; and speaker means connected with said radio frequency receiver circuit means for reproducing received RF signals as audible sounds.

11. The combination room monitoring baby bottle attachment and battery charger according to claim 9, further comprising:

night light means on said battery charging unit housing electrically connected with said power source for emitting light.

12. The combination room monitoring baby bottle attachment and battery charger according to claim 9, further comprising:

clock means on said battery charging unit housing electrically connected with said power source for indicating time.

* * * * *